United States Patent [19]

Mitchell

[11] Patent Number: 4,827,614

[45] Date of Patent: May 9, 1989

[54] DOUBLE SAFETY LOCK AND QUICK RELEASE TOOL AND TOOL HOLDER ASSEMBLY

[76] Inventor: John Mitchell, 11110 Gainsborough Ct., #9, Fairfax, Va. 22030

[21] Appl. No.: 162,845

[22] Filed: Mar. 2, 1988

[51] Int. Cl.[4] ..... B26B 29/02

[52] U.S. Cl. ..... 30/151; 224/232; 224/904

[58] Field of Search ..... 30/151, 143, 164; 224/232, 245, 253, 270, 901, 904

[56] References Cited

U.S. PATENT DOCUMENTS

| | | | |
|---|---|---|---|
| 2,391,574 | 12/1945 | Housinger | 224/2 |
| 2,527,710 | 10/1950 | Davidson, Jr. | 224/4 |
| 2,618,057 | 11/1952 | Gibson | 224/245 |
| 2,783,536 | 3/1957 | McQueary | 30/151 |
| 2,793,434 | 5/1957 | Wigington | 30/151 |
| 2,859,516 | 11/1958 | McQueary | 224/245 |
| 2,901,823 | 9/1959 | Widen | 224/232 |
| 3,524,570 | 8/1970 | Seguine | 224/245 |
| 4,404,747 | 9/1983 | Collins | 30/151 |
| 4,435,868 | 3/1984 | McQueen | 30/151 X |
| 4,558,516 | 12/1985 | Collins | 30/151 |
| 4,617,735 | 10/1986 | Silverstein | 30/151 |
| 4,645,104 | 2/1987 | Vokaty | 224/904 |
| 4,690,316 | 9/1987 | Peterson | 224/904 |
| 4,726,498 | 2/1988 | Esposito | 30/151 X |

*Primary Examiner*—Frank T. Yost
*Assistant Examiner*—Michael D. Folkerts
*Attorney, Agent, or Firm*—Varndell Legal Group

[57] ABSTRACT

A double safety lock and quick release tool and tool holder assembly comprising a locking portion in the tool holder including two apertures and a matching locking mechanism in the handle of the tool. The locking mechanism including a pair of springs, each spring having a locking pin at one end and being fastened at the other end within the handle of the tool, the two locking pins protruding above the surface of the tool handle and tightly fitting within the two apertures of the tool holder. The locking mechanism also including two activators, each activator having a portion extending outside the tool handle and a portion within the tool handle resting on one of the springs. When the activators are pushed, the springs are forced downward, resulting in the locking pins being moved downward from the surface of the tool handle and out of the apertures of the tool holder, thereby releasing the tool from the tool holder.

10 Claims, 1 Drawing Sheet

DOUBLE SAFETY LOCK AND QUICK RELEASE TOOL AND TOOL HOLDER ASSEMBLY

BACKGROUND OF THE INVENTION

This invention relates to a tool having a handle and a tool holder therefor. The tool and tool holder include means for securely locking the tool within the tool holder and for permitting quick release of the tool from the tool holder. The present invention is particularly suitable for securely retaining a knife in a sheath.

Most tool holders or sheaths that have been designed for carrying tools or knives are intended to permit the tool or knife to be pulled quickly from the tool holder or sheath. In some instances, however, the sheath is provided with a flexible strap or loop to hold the knife securely in position. In this type of configuration, the strap or loop usually fits either over the entire knife handle or a projection located somewhere on the knife handle.

In another configuration, a single locking projection or lip together with a matching recess or notch is used to secure the knife within the sheath. In some of these configurations, the single locking projection or lip is associated with a button, which when depressed or activated removes the single locking projection or lip from the corresponding recess or notch, so that the knife can be removed from the sheath. In other configurations, the single locking projection or lip is associated with a lever, so that pushing the lever in an appropriate direction removes the projection or lip from the corresponding recess or notch.

There is also known a double lock mechanism. This configuration includes two locking plates having a right angular bent up catch, secured to the sheath. This catch engages another catch located on the guard of a knife, when the knife is inserted into the sheath.

The means known in the art for securing a knife in a sheath do not provide for adequate protection against accidental removal of the knife and/or can not be quickly removed from the sheath. These deficiencies in the prior art mechanisms are especially serious with a knife worn in unusual environmental situations, such as can occur when the knife is worn by divers or parachutists. Divers and parachutists require a knife and sheath combination in which the knife will remain in the sheath during normal movement when diving or parachuting, but which can be quickly and easily removed and returned when desired. The sheath constructions heretofore in use by divers and parachutists either do not securely hold the knife in the sheath during normal movement of the diver or parachutist or do not ordinarily permit easy and quick removal of the knife.

For example, the strap or loop commonly used has to be stretched or snapped by the user. This inhibits quick removal of the knife. Due to the fact that a diver or parachutist must sometimes work quickly in a situation where they cannot view removal of the knife, it is not always easy to free the knife from the loop and then remove it from the sheath. For similar reasons, it is not always easy for the user to return the knife to the sheath and secure it in place.

With a single locking configuration of the button or lever activating type, two motions are usually required to remove the knife from the sheath, thereby increasing the time necessary for removing the knife which diminishes its usefulness in emergency situations, such as those which a diver or parachutist may encounter. Also, the single locking button or lever can be accidentally activated, so that knife will accidentally be removed from the sheath, thereby causing possible injury to the user. Further, even if accidental removal of the knife from the sheath does not cause personal injury to the user, loss of the knife can sometimes result. This can be very dangerous in unusual environmental situations, such as occur when the knife is carried by divers or parachutists.

In the double locking configuration, many different and awkward motions are needed to remove the knife from the sheath. This makes quick removal of the knife extremely difficult.

Another problem with the prior art assemblies is thaft if a part or component of the lock and release mechanism breaks, the entire lock and release mechanism does not function, usually resulting in the knife and sheath being discarded.

SUMMARY OF THE INVENTION

The present invention resolves the above-noted disadvantages of the prior art. In the present invention there is provided a knife and sheath combination especially adapted to securely retain the knife in the sheath, as well as provide for quick removal of the knife from the sheath. The present invention is designed to withstand undesired removal of the knife under a variety of conditions normally encountered in use, as well as those situations of unusual conditions. Further, the present invention permits one-handed simple removal of the knife from a sheath without visual assistance and further permits one-handed single motion return of the knife to the sheath, also without visual assistance. In addition to one-handed removal and return of the knife from the sheath, the present invention also permits that the normal motion used in grasping the knife is the same motion used for disengaging or engaging the locking of the knife from or into the sheath, thereby permitting the knife to be removed from the sheath or returned the sheath in one overall motion.

A futher object of the present invention is to provide a construction in which the various parts of the assembly, such as the knife handle, can be easily disassembled, so that one or more of the components can be replaced. Thus, in the present invention if one part or component of the lock and release mechanism breaks, it can be easily replaced. This assures that the assembly of the present invention will provide continued usefulness over a long period of time.

DETAILED DESCRIPTION OF THE INVENTION

In the present invention there is an improved mechanism for securing a tool in a tool holder therefor. The tool and tool holder include means having a dual locking mechanism for securely locking the tool within the tool holder and for permitting quick release of the tool from the tool holder. The present invention provides for quick release of the tool from the tool holder by a single motion, the same as that normally used to release the tool from the tool holder if there was no locking mechanism employed. For example, the present invention provides for release of the tool from the tool holder by simply grasping the tool with the forefinger and thumb of one hand, whereby each of the forefinger and the thumb engage and unlock one of two locking mechanisms.

The present invention is particularly suitable for a knife and a sheath. While the descriptions below are directed to knife and sheath, the present invention is not limited thereto. The present invention relates any type of tool in which secure locking within the tool holder and quick releasing from the tool holder are desired. Adaptations for various tools and tool holders therefor will be apparent from the following descriptions.

Figure 1:
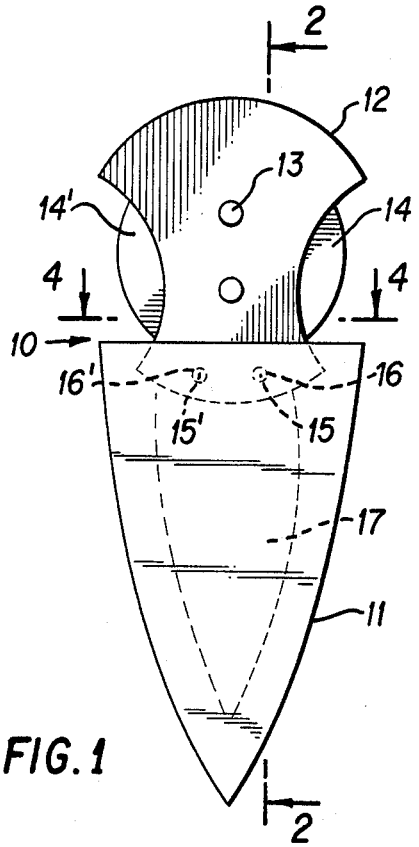
FIG. 1 is an embodiment of the present invention showing a front view of a knife in a sheath.

Referring to the drawings wherein like reference characters designate like or corresponding parts throughout the several views, there is shown in FIG. 1 a combination of a knife and sheath 10 in a locked configuration, including sheath 11, and knife handle 12. The knife handle 12 includes allen screws 13 or other removable fastening means for holding the handle together. The allen screws or other removable fastening means for holding the handle together permit the handle to be disassembled, so that any of the components of the present invention within the handle can easily be replaced, if necessary. FIG. 1 also shows various components of the locking mechanism contained in the handle, namely, activator means 14, 14' and locking pin means 15, 15'. Locking pin means 15, 15' mate with corresponding apertures or holes 16, 16' in sheath 11, as shown for locking pin means 15 and aperture 16 in FIG. 2. The locking pin means 15, 15' of the handle tightly fit within the corresponding apertures or holes 16, 16' of the sheath 11 to securely hold the knife within the sheath. The knife blade may have any suitable type of configuration, such as Bowie or single edge design or a double cutting edge design as shown at 17. The sheath can have a shape matching that of the knife blade and can entirely cover the blade of the knife or only a portion thereof. The sheath can be made of leather or suitable plastic, such as polyethylene, acrylate, acrylonitrile-butadienestyrene (ABS), or high impact polystyrene (HIPS).

Also, the handle may be inlaid, such as with mother of pearl or stainless steel.

Figure 2:
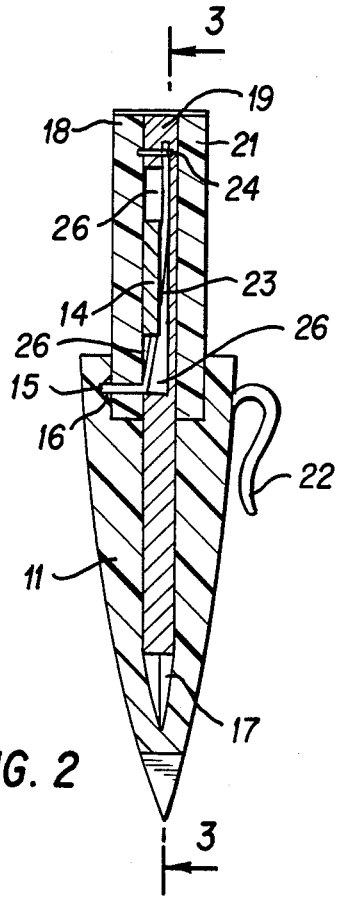
FIG. 2 is a cross sectional view taken along line 2—2 of FIG. 1.

FIG. 2 is a cross-sectional view taken along line 2—2 of FIG. 1 and shows the knife handle top portion 18 and knife handle bottom portion 21. FIG. 2 shows the tang 19 of the knife extending all the way through the knife handle, which is a preferred embodiment. However, the tang need not extend all the way through the knife handle, but may extend only through a portion thereof. In this later configuration, knife handle top portion 18 and bottom knife handle portion will be modified accordingly.

FIG. 2 also shows the knife sheath matching the shape of the knife. This is preferred, because it will result in a more secure locking mechanism. The knife sheath may be attached to the user by means of a spring clip 22, or by other appropriate means. A wedge shaped piece (not shown) may also be provided between the sheath and spring clip 22, so that the knife handle extends away from the user's body. This wedge shaped piece may be made of the same material as the knife sheath or of another material.

Figure 3:
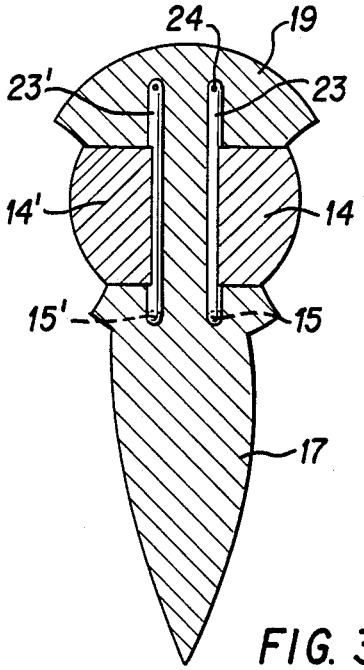
FIG. 3 is a cross sectional view taken along line 3—3 of FIG. 2, showing an embodiment of the locking mechaanism according to the present invention.
Figure 4:
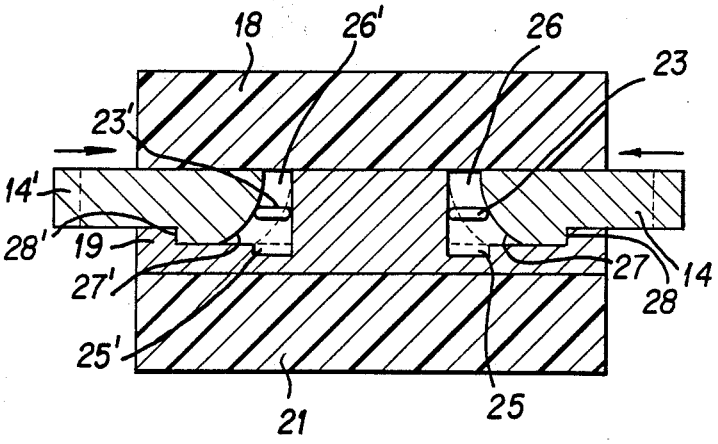
FIG. 4 is a sectional view taken along line 4—4 of FIG. 1, showing an enlarged cross section of an embodiment of the locking mechanism of the present invention.

FIGS. 2–4 show the dual locking mechanism of the present invention. Spring 23 has pin 24 at one end for fastening the spring 23 within the handle and locking pin means 15 at the other end. As shown in FIG. 2, spring 23 extends from near the rear of the knife handle, behind and/or below actuator 14 and to the top of the knife handle, where it joins the locking pin means 15.

FIG. 2 shows that aperture 16 closely matches the shape of locking pin means 15. However, aperture 16 does not extend through the sheath. The aperture can have a shape which does or does not closely match that of locking pin means 15. It is preferred that at least the upper part of the aperture 16 has a shape matching that of the top portion of the locking means 15, so as to assure a tight lock. Preferably, the aperture 16 has a beveled surface, with the upper portion thereof extending from slightly below the top of the aperture 16 next to locking pin means 15 to the inner portion of the sheath further away from the locking pin means 15, as shown in FIG. 2. This beveled surface facilitates easier action of the locking pin in and out of the aperture.

Apertures 16, 16' can extend completely through the sheath, although this may not be desirable, because this may impede the safety of the mechanism, in that it could be accidentally opened by a force exerted on the locking pin means from above the sheath. In such a configuration, the height at locking pin means 15, 15' will be lengthened accordingly.

Spring 23 can be a strip of spring steel which can have a slightly upward curvature, as shown in FIG. 2, which can extend across a lengthwise portion of the handle, as shown in FIGS. 2 and 3, and which can have a rectangular cross-section, as shown in FIG. 4. The springs 23, 23' or a portion thereof can be held within channels 25, 25' as shown in FIG. 4, in order to more securely retain the spring in the proper position. As best shown in FIG. 4 open areas 26, 26' are provided within the knife handle to permit movement of the springs 23, 23' and actuators 14, 14'. The channels 25, 25', as well as open areas 26, 26' are usually provided in the tang. However, a portion or all of either channels 25, 25' or open areas 26, 26' can be provided in other parts of the knife handle, such as knife handle top portion 18 or knife handle bottom portion 21. This is especially true when the tang does not extend all the way through the knife handle.

Activators 14, 14' rest upon springs 23, 23', as shown in FIGS. 3 and 4 and are held in the knife handle by retaining means. The retaining means can include surface 28, 28', which holds the activator within the handle while permitting movement within the handle. Springs 23, 23' exerts a slight pressure upon activators 14, 14', the amount of this pressure can be adjusted by adjusting screws (not shown) to suit the user. Actuators 14, 14' have a curved surface 27, 27' which rest upon springs 23, 23', as shown in FIG. 4. When pressure is exerted on actuators 14, 14' in an inwardly direction (i.e., pushing the actuators 14, 14' towards each other as shown by the arrows), the curved surfaces 27, 27' of the activators push the springs 23, 23' downward. This causes locking pin means 15, 15' to retract from apertures 16, 16', which unlocks the knife from the sheath, so that the knife can be removed from the sheath. The releasing pressure can be exerted on the activation by, for example, simply grasping the knife handle about the activators with the forefinger and thumb of one hand. This enables the knife to be withdrawn or removed from the sheath with one motion of simply grasping the knife upwardly.

As mentioned above, the knife handle is held together by allen screws 13 or other removable or non-removable fastening means. Removable fastening means are preferred, because this allows separation of the two halves of knife handle body, and permits replaceability of the various parts of the present invention. For example, if spring 23 breaks or becomes worn, the knife handle can be opened, and spring 23 can be replaced with a new spring.

Various modifications and changes are contemplated and may be resorted to without departing from the function or scope of the invention defined by the appended claims.

I claim:

1. A double safety lock and quick release tool and tool holder assembly comprising: a tool having a handle and a working portion and a tool holder for receiving at least a part of the working portion of the tool, the tool holder having a locking portion covering at least a part of the tool handle, the locking portion including two apertures, the tool handle having locking means, the locking means including a pair of springs, each spring having a locking pin means at one end and fastening means for securing the spring within the handle of the tool at another end thereof, the spring being located within the tool handle, with the locking pin means protruding above the surface of the tool handle and tightly fitting within the two apertures of the tool holder, the locking means also including an activator means, the activator means including two activated elements located within a portion of the tool handle and having a portion extending outside of the tool handle, each activator element means being located adjacent to and resting on a respective spring, so that when the activator element is pushed toward the respective spring, the locking pin is forced downward from the surface of the tool handle and out of the apertures of the tool holder.

2. The assembly as claimed in claim 1, wherein the tool is a knife, the working portion is a knife blade, and the tool holder is a sheath.

3. The assembly as claimed in claim 2, wherein the springs are elongated strips of spring steel.

4. The assembly as claimed in claim 3, wherein the knife handle includes an alignment means for holding the springs in position.

5. The assembly as claimed in claim 4, wherein the alignment means is a channel located about a portion of the bottom surface of the springs.

6. The assembly as claimed in claim 2, including retaining means for permitting movement of the activator elements and for retaining the activator elements within the knife handle.

7. The assembly as claimed in claim 6, wherein the retaining means includes a channel having two parallel surfaces interconnected by a ridge therebetween, each activator element having a surface matching that of the retaining means, and each activator element resting upon the retaining means.

8. The assembly as claimed in claim 7, wherein each activator element has a curved working portion and the springs are elongated strips of spring steel having a rectangular cross-section, the curved surface of each activator resting on an edge of the respective spring.

9. The assembly as claimed in claim 8, werein the springs and activator elements are arranged so that each spring exerts a slight pressure on a respective activator element pushing the activator element up against the retaining means.

10. The assembly as claimed in claim 2, wherein the handle is in two halves and held together by screws.

* * * * *